United States Patent [19]

Kaji

[11] 4,355,566

[45] Oct. 26, 1982

[54] VALVE DRIVING APPARATUS

[75] Inventor: Shoichi Kaji, Yamanashi, Japan

[73] Assignee: Kitazawa Valve Co., Ltd., Tokyo, Japan

[21] Appl. No.: 109,404

[22] Filed: Jan. 3, 1980

[30] Foreign Application Priority Data

Jun. 8, 1979 [JP] Japan ..... 54-78107[U]
Jun. 8, 1979 [JP] Japan ..... 54-78109[U]

[51] Int. Cl.[3] ..... F15B 15/24; F01B 29/04; F01B 9/00

[52] U.S. Cl. ..... 92/13.6; 92/128; 92/130 C; 92/138; 91/59; 137/269; 251/58; 74/104

[58] Field of Search ..... 92/138, 130 R, 130 A, 92/130 B, 130 C, 130 D, 13.6, 13.8, 128; 251/58; 91/54; 74/104; 137/269

[56] References Cited

U.S. PATENT DOCUMENTS

| | | | |
|---|---|---|---|
| 1,347,055 | 7/1920 | Peterson | 92/138 |
| 3,104,592 | 9/1963 | Sheesley | 74/104 |
| 3,253,518 | 5/1966 | Duemler | 92/138 |
| 3,614,913 | 10/1971 | Clark | 92/138 |
| 3,818,808 | 6/1974 | Shafer | 92/138 |
| 4,170,169 | 10/1979 | Shafer | 92/130 R |

*Primary Examiner*—Paul E. Maslousky
*Attorney, Agent, or Firm*—Wenderoth, Lind & Ponack

[57] ABSTRACT

A valve driving apparatus comprising a case proper provided in the interior thereof with a movement conversion-transmission mechanism, a cylinder mechanism freely detachably fixed to one end of the case proper and a piston rod supporting mechanism freely detachably fixed to the other end of the case proper so as to be applicable to any kind of valve merely by the replacement of the mechanisms between which the case proper intervenes.

3 Claims, 9 Drawing Figures

VALVE DRIVING APPARATUS

BACKGROUND OF THE INVENTION

The present invention relates to a valve driving apparatus provided on a valve such as a ball valve, butterfly valve, plug valve, etc. and adapted to cause a valve stem to be rotated to thereby open and shut the valve body.

There have heretofore been known two kinds of valve driving apparatuses, one of which is a double-acting cylinder type (including a double-acting two-cylinder type) valve driving apparatus utilizing as a power source a gas such as compressed and pressurized air, nitrogen, etc. or a liquid such as pressurized oil etc. (hereinafter referred to totally as "pressurized fluid") and the other of which is a spring-return type valve driving apparatus provided with a reciprocating cylinder and a compression coil spring extended to thereby cause a piston to be moved to the original position by means of its restoring force after compressed by the action of the reciprocating cylinder. The apparatus of either type is provided with a conversion mechanism for converting the reciprocating movement of a piston rod within the cylinder into a rotating movement and at the same time transmitting the rotating movement to a driving shaft provided on the valve stem.

In the continuously reciprocating movements of the piston and the piston rod of the valve driving apparatus, there occurs an adverse phenomenon that the piston rod itself is given a rotating movement relative to the center axis thereof due to an eddy current of the pressurized fluid introduced into the cylinder or frictional displacements in the rod bearing portions or, in the case of the spring-return type valve driving apparatus, due to a twisting action of the spring being compressed and extended. Particularly when a scotch yoke type conversion mechanism is used and the openings of the scotch yokes are disposed at right angles relative to the piston rod, the piston rod and pins fixed on the piston rod are rotated in the direction of the width of the piston rod and, therefore, the parallel relation between the pins and the driving shaft of the valve driving apparatus cannot be maintained, with the result that the pins are moved out of engagement with the openings of the scotch yokes. Therefore, the associated movement between the piston rod and the scotch yokes cannot be maintained. This means that the valve driving apparatus cannot fulfill its function to exactly open and shut the valve body.

In order to prevent the aforementioned adverse phenomenon from occurring, there has heretofore been adopted means comprising a pair of grooves formed on the inner surface of a case proper of the valve driving apparatus parallel with the piston rod with the extremities of a pair of elongated pins inserted and held therein, whereby the rotating force of the piston rod is countered, or means comprising a pair of plane surfaces formed on the fixing portions between the piston rod and the pins and inserted between yoke portions provided on the driving shaft.

In the case of the spring-return type valve driving apparatus, the movement and force produced by the cylinder must cause the driving shaft to be rotated and the compression coil spring to be compressed. Therefore, the force for rotating the valve stem is reduced by the force for compressing the compression coil spring to an extent of about one half of the force for rotating the valve stem required in the case of the double-acting cylinder type valve driving apparatus.

Under these circumstances, it has heretofore been necessary to prepare a plurality of valve driving apparatus in advance and to select one of the prepared valve driving apparatuses in accordance with the driving force required by the valve body to be driven.

SUMMARY OF THE INVENTION

In order to overcome the disadvantages described above, the present invention has been provided.

One object of the present invention is to provide a valve driving apparatus capable of driving any kind of valve irrespective of the magnitude of the driving force required by the valve body to be driven.

Another object of the present invention is to provide a valve driving apparatus having a simple construction capable of causing the valve body to be opened and shut exactly and stably.

To accomplish the objects described above, according to the present invention, there is provided a valve driving apparatus comprising a case proper accommodating therein a movement conversion-transmission mechanism, a cylinder mechanism freely detachably fixed to one end of the case proper and a piston rod supporting mechanism freely detachably fixed to the other end of the case proper.

The other objects and characteristic features of the present invention will become apparent from the description given hereinafter in detail with reference to the accompanying drawing.

DETAILED DESCRIPTION OF PREFERRED EMBODIMENT

Figure 1:
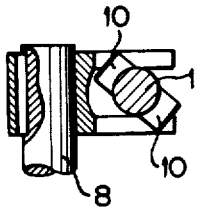
PRIOR ART FIG. 1
FIG. 1 is a partially cut-away longitudinal cross section illustrating the principal portion of one existing valve driving apparatus.
Figure 2:
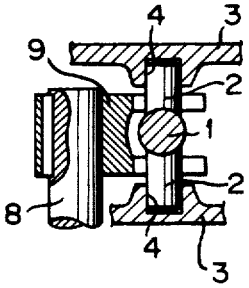
PRIOR ART FIG. 2
FIG. 2 is a partially cut-away longitudinal cross section of the principal portion of another existing valve driving apparatus.
Figure 3:
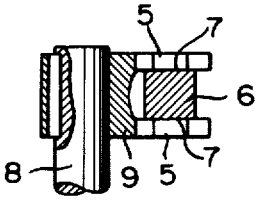
PRIOR ART FIG. 3
FIG. 3 is a partially cut-away longitudinal cross section of the principal portion of still another existing valve driving apparatus.

FIGS. 1, 2 and 3 are partially cut-away longitudinal cross sections illustrating scotch yoke type movement conversion-transmission mechanisms of existing valve driving apparatuses. When the openings of the scotch yokes are disposed at right angles relative to the piston rod 1, the piston rod and pins 10 fixed on the piston rod are rotated in the direction of the width of the piston rod as illustrated in FIG. 1 and, therefore, the parallel relation between the pins and the driving shaft 8 of the valve driving apparatus cannot be maintained, with the result that the pins are moved out of engagement with the openings of the scotch yokes. Therefore, the associated movement between the piston rod and the scotch yokes cannot be maintained. This means that the valve driving apparatus cannot fulfill its function to exactly open and shut the valve body.

In order to prevent the aforementioned adverse phenomenon from occurring, there has heretofore been adopted means comprising a pair of grooves 4 formed on the inner surface of a case proper 3 of the valve driving apparatus in parallel with the piston rod 1 with the extremities of a pair of elongated pins 2 inserted and held therein, whereby the rotating force of the piston rod is countered (FIG. 2), or means comprising a pair of plane surfaces 7 formed on the fixing portions between the piston rod 6 and the pins 5 and inserted between yoke portions 9 provided on the driving shaft 8 (FIG. 3).

The present invention will be described hereinafter in detail with reference to the accompanying drawing.

Figure 4:
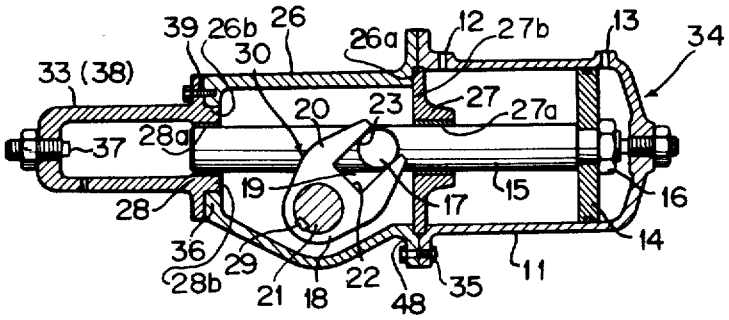
FIG. 4 is a lateral cross section illustrating one embodiment of the valve driving apparatus according to the present invention.

FIG. 4 illustrates one embodiment of the valve driving apparatus according to the present invention which is of a double-acting cylinder type utilizing a pair of scotch yokes as a movement conversion-transmission mechanism. The valve driving apparatus comprises a case proper 26, a cylinder mechanism 34 freely detachably fixed to a flange portion 48 of the case proper with bolts 35 and a stop member 38 as a piston rod supporting mechanism having a housing 33 freely detachably fixed to an attaching portion 36 of the case proper with bolts 39. The cylinder mechanism 34 comprises a cylinder 11 having ports 12 and 13 serving as inlet and outlet for a pressurized fluid, a piston 14 disposed inside the cylinder and a piston rod 15 fixed to the piston by means of a nut 16 so that it may be moved in the rightward and leftward directions in conjunction with the piston. The piston rod 15 is movably supported in bearing apertures 27*a* and 28*a* of bearing portions 27 and 28 received in bearing portion receiving apertures 26*a* and 26*b* in casing 26. Bearing portion 27 has a circumferential portion 27*b* fitting into aperture 26*a*. Bearing portion 28 has a projection 28*b* thereon fitting into aperture 26*b*. The piston 14 shown in FIG. 4 is in a state wherein it has reached the rightward extremity of its moving range. When a pressurized fluid is introduced from the port 13 into the cylinder 11, the piston in such a state is moved in the leftward direction. Thereafter, when a pressurized fluid is introduced from the port 12 into the cylinder 11, the piston is moved in the rightward direction, with the result that the fluid introduced from the port 13 into the cylinder is discharged out of the cylinder from the port 13 since it is no longer pressurized due to the changeover of a switch valve (not shown) connected to the ports 12 and 13. The cylinder mechanism as constructed above is capable of producing a given output. The stop member 38 as the piston rod supporting mechanism 33 is provided with a stop 37. The case proper 26 is provided in the interior thereof with a movement conversion-transmission mechanism 30 for converting the reciprocating movement into a rotating movement and at the same time transmitting the rotating movement to a driving shaft 21 mounted on a valve stem (not shown) of a valve to be driven.

Figure 5:
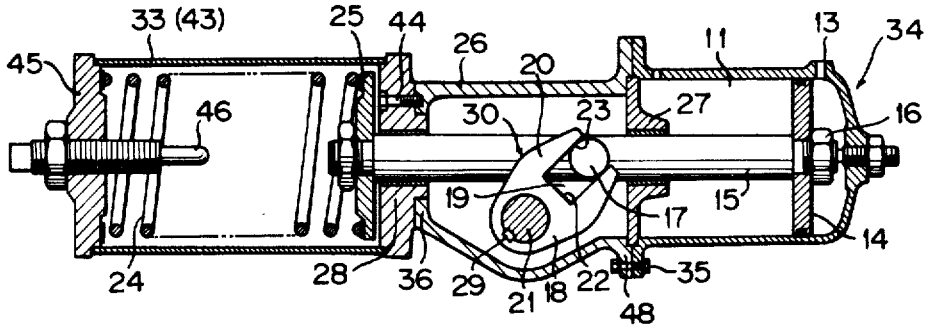
FIG. 5 is a lateral cross section illustrating another embodiment of the valve driving apparatus according to the present invention.

Since the valve driving apparatus according to the present ivnention has a construction in which the case proper and the stop means are freely detachably fixed to each other, there can be provided a spring-return type valve driving apparatus, as illustrated in another embodiment of FIG. 5, merely by replacing the stop member 38 with a spring box 43 as a piston rod supporting mechanism 33 or, if the occasion demands, a double-acting two-cylinder type valve driving apparatus (not illustrated) merely by substituting another cylinder mechanism capable of functioning in the same manner as the cylinder mechanism 34 for the stop member 38. In the embodiment of FIG. 5, the spring box 43 accommodates therein a compression coil spring 24 and is freely detachably fixed to the fitting portion 36 of the case proper 26 with bolts 44 and is possessed of a spring holder 25 fixed to the piston rod and a box cover 45 on which a stop 46 is provided.

In comparison between the valve driving apparatuses shown in FIGS. 4 and 5, since the outputs produced by the cylinders are the same and since the output produced by the cylinder of FIG. 5 is absorbed by the compression coil spring 24, the valve-driving force of the apparatus of FIG. 5 is reduced by the output absorbed by the spring. Therefore, the apparatus of FIG. 5 cannot be used for a valve capable of being fully driven by the apparatus of FIG. 4. However, since the valve driving apparatus has such a construction that the case proper 26 and the cylinder mechanism 34 are freely detachably fixed to each other, the valve fully driven by the apparatus of FIG. 4 can be driven in the same manner by replacing the cylinder mechanism 34 with another cylinder mechanism 34' having a cylinder 40 shown in still another embodiment of FIG. 6 which cylinder has a larger inner diameter than that of the cylinder 11 so as to produce a higher output than that of the cylinder 11 by an amount equal to the output absorbed by the compression coil spring 24.

The cylinder mechanism 34' of this embodiment comprises a cylinder 40 having ports 12 and 13 for inlet and outlet for a pressurized fluid, a piston 41 disposed inside the cylinder and a piston rod 15 fixed to the piston and is freely detachably fixed at the flange portion 47 thereof to the flange portion 48 which in turn has with bolts 35 and, therefore, it produces a higher output than that of the cylinder mechanism 34 of the embodiment of FIG. 5 and can function in the same manner as the cylinder mechanism 34.

As is clear from the above, the valve driving apparatus according to the present invention can be used as any type of apparatus such as an apparatus of a double-acting cylinder type, an apparatus of a spring-return type or an apparatus of a double-acting two-cylinder type and can be utilized for any valve merely by suitably selectively using the mechanisms between which the case proper is mounted.

Figure 6:
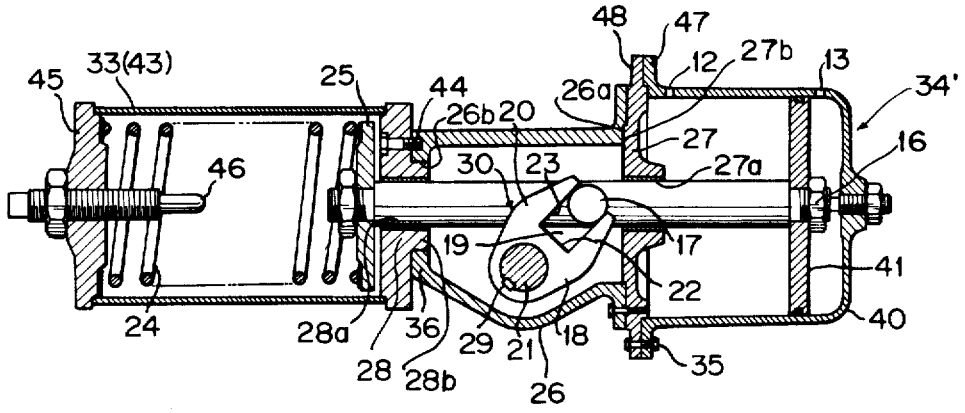
FIG. 6 is a lateral cross section illustrating still another embodiment of the valve driving apparatus according to the present invention.
Figure 7:
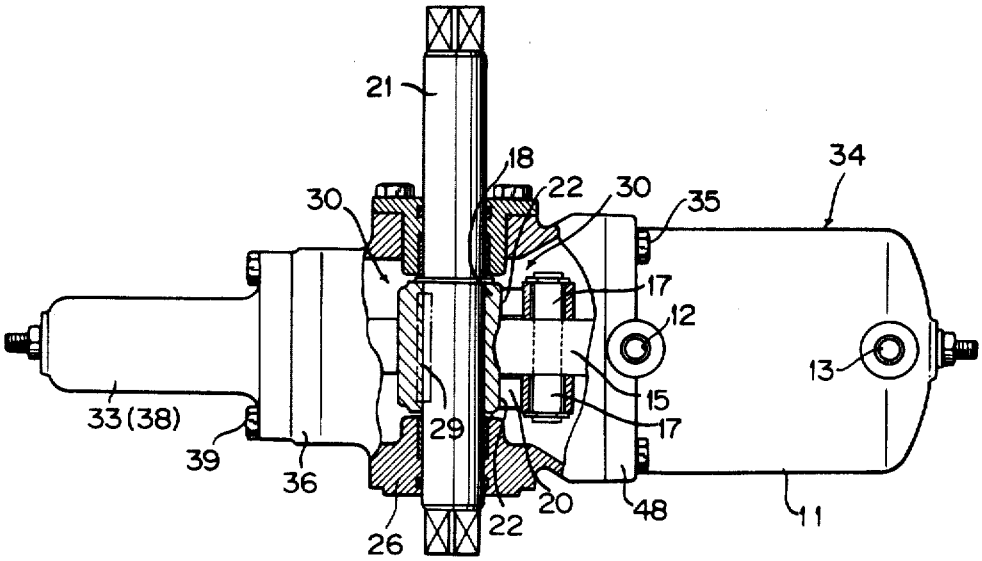
FIG. 7 is a partially cut-away enlarged front view of the valve driving apparatus of FIG. 4.
Figure 8:
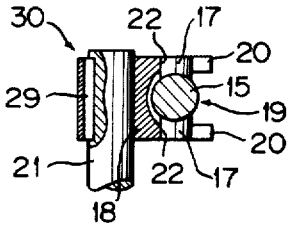
FIG. 8 is a partially cut-away longitudinal cross section of the principal part of the valve driving apparatus shown in FIGS. 4, 5 or 6.
Figure 9:
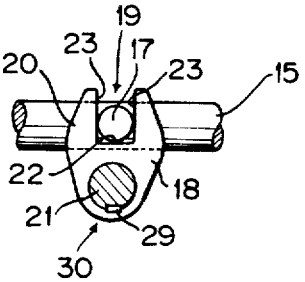
FIG. 9 is a partially cut-away plan view of FIG. 8.

The movement conversion-transmission mechanism 30 shown in FIGS. 4, 5 or 6 comprises a pair of pins 17 provided on the piston rod 15; a pair of scotch yokes 18, 18 each having yoke portions 20 and an opening 19 enclosed by a pair of opposed sliding surfaces 23 and a thrusting surface 22; and a key 29. The pin 17 is engaged with the opening 19. The mechanism 30 causes the scotch yokes to be swung relative to the driving shaft 21 connected to the valve stem (not shown) by causing the pins 17 to be slid on the sliding surfaces 23 in conjunction with the reciprocating movement of the piston rod 15. When the openings 19 of the scotch yokes are disposed at right angles relative to the piston rod, as shown in FIGS. 8 and 9, the peripheral surfaces of the pins 17 are in thrust contact with the thrusting surfaces 22 parallel to the peripheral surface of the driving shaft 21. When the openings are disposed aslant relative to the piston rod 15, as illustrated in FIGS. 4, 5 and 6, the pins 17 are in sliding contact with the sliding surfaces 23. Since the width of the opening 19 is substantially the same as the diameter of the pin 17 to permit the pin to slide on the sliding surfaces of the scotch yoke, the piston rod 15 is prevented from being rotated. The pins are thus maintained in a parallel relation to the driving shaft 21 at all times. Therefore, not only the drive of the pins 17 and the scotch yokes 18 but also the drive of the piston 14 and the spring holder 25 is exactly transmitted to the driving shaft 21 and, moreover, a valve can be rotated by exactly ninety degrees by the valve stem (not shown) connected with the driving shaft 21.

Since the pins provided on the piston rod are held in parallel with the driving shaft at all times, as described above, the valve can be rotated exactly and stably by the valve stem connected to the driving shaft and, at the same time, there is no danger that any part is damaged due to a considerably simpler construction than that of any existing valve driving apparatus. That is to say, the durability of the valve driving apparatus is conspicuously prolonged and mass production of the valve during apparatus can be effected at low cost.

Although the scotch yokes are used as the movement conversion-transmission mechanism in all the embodiments of the present invention, it goes without saying that there may selectively be adopted a link mechanism or a combination rack and pinion mechanism.

Thus, the present invention provides a very useful valve driving apparatuses from a practical point of view and contributes greatly to this field.

What is claimed is:

1. A valve driving apparatus comprising:

a casing having a first bearing portion receiving aperture at a first end thereof and a second bearing portion receiving aperture at a second end thereof and aligned with said first bearing portion receiving aperture along an axis;

a valve driving shaft extending through said casing transverse to and offset from said axis;

a movement conversion-transmission mechanism connected to said valve driving shaft;

a plurality of rods interchangably positionable in said casing along said axis and through said apertures and being connectable to said movement conversion-transmission mechanism, and each having a first end projecting through said first bearing portion receiving aperture and a second end projecting through said second bearing portion receiving aperture, each piston rod having a piston attaching means at the first end thereof and one piston rod having the second end free of any attaching means and a second piston rod having the second end with plate attaching means thereon;

a plurality of different size piston-cylinder mechanisms interchangably attachable to said first end of said casing, each piston-cylinder mechanism having (1) a cylinder with ports for the inlet and outlet of pressure fluid, (2) a piston slidable in said cylinder and attachable by the piston attaching means to the first end of a piston rod, and (3) a first bearing portion on the end of the cylinder which is toward said casing, said first bearing portion having a bearing aperture therethrough through which a piston rod extends when said piston-cylinder mechanism is attached to said casing and supporting the piston rod, and said first bearing portion further having a circumferential portion fitting into said first aperture in said casing, and each piston cylinder mechanism having a means for attaching it to said first end of said casing; and a plurality of piston rod movement control means interchangably attachable to said second end of said casing, each having (1) a housing with a bearing portion constituting an end plate with a projection thereon of a size for being matingly receiving in said second bearing portion receiving aperture in said casing, said bearing portion having a bearing aperture therethrough through which a piston rod extends when said piston rod movement control means is attached to said casing and supporting the piston rod, and (2) means for attaching said piston rod movement control means to said second end of said casing, one of said piston rod movement control means having a stop at the end thereof remote from the end plate thereof and the interior of said housing receiving only the piston rod and being traversed thereby and the housing being attached to said second end of said casing when the one piston rod is positioned in said casing, and a second of said piston rod movement control means having a stop at the end thereof remote from the end plate and a spring holder slidable in said housing and being attached to the second end of said second piston rod when said second piston rod is positioned in said casing and also having a spring in said housing between said spring holder and the end of the housing at which said stop is positioned.

2. A valve driving apparatus as claimed in claim 1 further comprising a third piston rod interchangably positionable in said casing and further piston rod movement control means interchangably attachable to said second end of said casing, the housing of said further piston rod movement control means being a cylinder with ports for the inlet and outlet of pressure fluid and a piston slidable in said cylinder and attached to the second end of said third piston rod when said third piston rod is positioned in said casing, and the means for attaching said further piston rod movement control means being a second bearing portion on the end of the cylinder which is toward said casing and having a projection thereon of a size for being matingly received in said second bearing portion receiving aperture in said casing, said bearing portion having a bearing aperture therethrough through which said third piston rod extends when said piston rod movement control means is attached to said casing and supporting said third piston rod, and means for attaching said further piston cylinder mechanism to said second end of said casing.

3. The valve driving apparatus according to claim 1, wherein said movement conversion-transmission mechanism is a scotch yoke type movement conversion-transmission mechanism which comprises a pair of pins provided on said piston rod; a pair of scotch yokes each including a pair of opposed sliding surfaces and a thrusting surface defining an opening for allowing said pin to be engaged therewith; and a key for swingably fixing said pair of scotch yokes to a driving shaft, said pair of pins being brought into sliding contact with said sliding surfaces when said opening is disposed aslant relative to said piston rod and, when said opening is disposed at right angles to said piston rod, being brought into thrust contact with said thrusting surface while maintaining the contact with said sliding surfaces so as to constantly maintain a parallel relation between said driving shaft and said pair of pins, whereby the valve is exactly and stably driven.

* * * * *